US007835667B2

(12) United States Patent
Ohno et al.

(10) Patent No.: US 7,835,667 B2
(45) Date of Patent: Nov. 16, 2010

(54) DISCHARGER, IMAGE CARRIER UNIT, AND IMAGE FORMING APPARATUS

(75) Inventors: Shigeo Ohno, Ebina (JP); Tsutomu Sugimoto, Ebina (JP); Tomoya Ichikawa, Ebina (JP); Yasuo Takayama, Ebina (JP); Yoji Yamaguchi, Ebina (JP); Yoshitaka Kuroda, Ebina (JP); Tohru Inoue, Ebina (JP); Kuniaki Tanaka, Ebina (JP); Takahiro Shinkawa, Ebina (JP); Hiroki Murakami, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 299 days.

(21) Appl. No.: 12/025,825

(22) Filed: Feb. 5, 2008

(65) Prior Publication Data

US 2008/0226334 A1 Sep. 18, 2008

(30) Foreign Application Priority Data

Mar. 16, 2007 (JP) ..... 2007-069409

(51) Int. Cl.
*G03G 15/02* (2006.01)

(52) U.S. Cl. ..... 399/171; 399/100

(58) Field of Classification Search ..... 399/92, 399/93, 100, 170, 171; 361/225, 229; 250/324, 250/325, 326

See application file for complete search history.

(56) References Cited

U.S. PATENT DOCUMENTS

| | | | | |
|---|---|---|---|---|
| 5,257,073 | A * | 10/1993 | Gross et al. | 399/171 |
| 5,485,255 | A * | 1/1996 | Reuschle et al. | 399/100 X |
| 6,339,688 | B1 * | 1/2002 | Cho et al. | 399/93 |
| 2006/0218907 | A1 * | 10/2006 | Lynch | 60/323 |

FOREIGN PATENT DOCUMENTS

| | | | |
|---|---|---|---|
| JP | 11-24373 | A | 1/1999 |
| JP | 2000-58225 | A | 2/2000 |
| JP | 2002-268334 | A | 9/2002 |
| JP | 2004-198909 | A | 7/2004 |
| JP | 2005-227470 | A | 8/2005 |

OTHER PUBLICATIONS

First Office Action dated Jun. 2, 2010 issued in counterpart Chinese Application No. 200810006148.0

* cited by examiner

*Primary Examiner*—Sandra L Brase
(74) *Attorney, Agent, or Firm*—Sughrue Mion, PLLC

(57) ABSTRACT

A discharger includes: a discharge electrode member that is placed opposedly to a member to be charged; an opposed electrode member that is placed opposedly to the discharge electrode member; and a power source circuit that applies a discharge voltage for generating a discharge between the discharge electrode member and the opposed electrode member, and the electrode member having a surface that includes a covered layer covered by a covering material is formed on a surface opposed thereto, and the covering material containing a carbon atom, or a carbon atom and another atom or other plural atoms as a main component, and having an SP3 structure by a carbon atom.

8 Claims, 13 Drawing Sheets

FIG. 7

| | METHOD | RESULT (TEMPORARY SPEC < G2.5@200kpv | |
|---|---|---|---|
| COMPARATIVE EXAMPLE 6 | INTERVAL OF CLEANING IS SET FROM 5 kpv TO 3kpv | G2.5 (J ZONE 120kpv) | × |
| COMPARATIVE EXAMPLE 7 | AMOUNT OF BITING OF CLEANING BRUSH IS INCREASED BY 0.5mm | G2.0-G2.5 (J ZONE 50kpv) | × |
| COMPARATIVE EXAMPLE 8 | POLISHING SHEET IS ADDED TO NET-LIKE ELECTRODE CLEANING PORTIONS | G2.0-G2.5 (J ZONE 50kpv) | × |
| COMPARATIVE EXAMPLE 9 | WHILE AIR INTAKE AMOUNT IS UNCHANGED, AIR DISCHARGE AMOUNT IS CHANGED TO 1/2 OF PRESENT AMOUNT | G2.5 (J ZONE 100kpv) | × |
| COMPARATIVE EXAMPLE 10 | SEALING MEMBER IS ADDED TO UPPER SIDE OF DEVELOPING DEVICE TO PREVENT TONER CLOUD FROM GOING AROUND | G2.0 (ONLY REAR SIDE IS IMPROVED) (J ZONE 50kpv) | × CONCENTRATION DIFFERENCE BETWEEN IN/OUT IS LARGE |
| COMPARATIVE EXAMPLE 11 | CHANGE SHAPE OF DUCT (PRESENT) MIN 0.04m/s, MAX 0.6m/s (COUNTERMEASURE) MIN 0.33m/s, MAX 0.68m/s | G1.5 (ONLY IN REAR SIDE, MIDDLE PORTION IS IMPROVED) (J ZONE 50kpv) | △ |
| EXPERIMENTAL EXAMPLE 1 | COAT OF ta-C | G0-G0.5 (J ZONE 206kpv) | ◎ |

FIG. 8A

| | COAT THICKNESS | I-V CHARACTERISTIC ※NO ENVIRONMENT DEPENDENCE | MECHANICAL STRENGTH (CORRESPONDING TO 280kpv OF CLEANING BRUSH) | RUNNING OF ACTUAL APPARATUS (J ZONE) |
|---|---|---|---|---|
| EXAMPLE 2 | 100Å | ○ | ○ | ○ (252kpv) |
| EXAMPLE 3 | 500Å | ○ | ○ | ○ (262kpv) |
| EXAMPLE 4 | 1000Å | ○ | ○ | — |
| EXAMPLE 5 | 10000Å (= 1μm) | △ (POTENTIAL IS LOWERED BY ABOUT 10V LIFE) | ○ | ○ (206kpv) |

※ LIFE: 200kpv

DISCHARGER, IMAGE CARRIER UNIT, AND IMAGE FORMING APPARATUS

CROSS-REFERENCE TO RELATED APPLICATIONS

This application is based on and claims priority under 35 U.S.C. 119 from Japanese Patent Application No. 2007-069409 filed Mar. 16, 2007.

BACKGROUND

1. Technical Field

The present invention relates to a discharger, an image carrier unit comprising the discharger, and an image forming apparatus.

2. Related Art

In a conventional image forming apparatus of the electrophotographic system, such as a copier or a printer, the surface of an image carrier such as a photosensitive member is charged by a charging device, an electrostatic latent image is formed on the charged surface of the image carrier, the latent image is developed, and the developed image is transferred to a medium, thereby forming an image. As the image carrier, widely used are a contact type charging device which rotates in contact with or in proximity to an image carrier to charge the image carrier, or a so-called charging roller, and a non-contact discharge type charging device which is placed opposedly to an image carrier, and which charges the surface of the image carrier by means of a discharge between electrodes, or a so-called corotron or scorotron.

SUMMARY

According to an aspect of the present invention, a discharger includes: a discharge electrode member that is placed opposedly to a member to be charged; an opposed electrode member that is placed opposedly to the discharge electrode member; and a power source circuit that applies a discharge voltage for generating a discharge between the discharge electrode member and the opposed electrode member, and the electrode member having a surface that includes a covered layer covered by a covering material is formed on a surface opposed thereto, and the covering material containing a carbon atom, or a carbon atom and another atom or other plural atoms as a main component, and having an SP3 structure by a carbon atom.

BRIEF DESCRIPTION OF THE DRAWINGS

Exemplary embodiment of the present invention will be described in detail based on the following figures, wherein:

FIGS. 4A and 4B are section diagrams of main portions of the charging device of Example 1 of the invention in which FIG. 4A is a view illustrating main portions of the right side of the charging device, and FIG. 4B is a view illustrating main portions of the left side of the charging device;

FIGS. 6A and 6B are views showing experimental results of Experiment 1 in Example 1 in which FIG. 6A is a graph of experimental results of Comparative examples 1 to 4 in which the abscissa indicates the number of printed sheets and the ordinate indicates the grade of a white streak, and FIG. 6B is a graph of experimental results of Comparative example 5 in which the abscissa indicates the number of printed sheets and the ordinate indicates the grade of a white streak;

FIG. 7 is a view showing experimental results of Experimental example 2;

FIGS. 8A and 8B are views showing experimental results of Experiment 3 in which FIG. 8A shows a list of the experimental results, and FIG. 8B is a graph showing experimental results of electric performances;

FIGS. 9A to 9D are diagrams illustrating the principle that the resistance of a photosensitive member is lowered, and in which FIG. 9A is a diagram of a state at the start of a discharge, FIG. 9B is a diagram of a state where the discharge is continued, FIG. 9C is a diagram of a state where nitrogen oxides are emitted after an end of the discharge, and FIG. 9D is a diagram of a state where the resistance of the photosensitive member is lowered; and FIGS. 10A and 10B are views showing experimental results of Experiment 4 in Example 2 in which FIG. 10A is a graph of experimental results of Experimental example 7 in which the abscissa indicates the time and the ordinate indicates the concentration, and FIG. 10B is a graph of experimental results of Comparative example 12 in which the abscissa indicates the time and the ordinate indicates the concentration.

DETAILED DESCRIPTION

Figure 1:
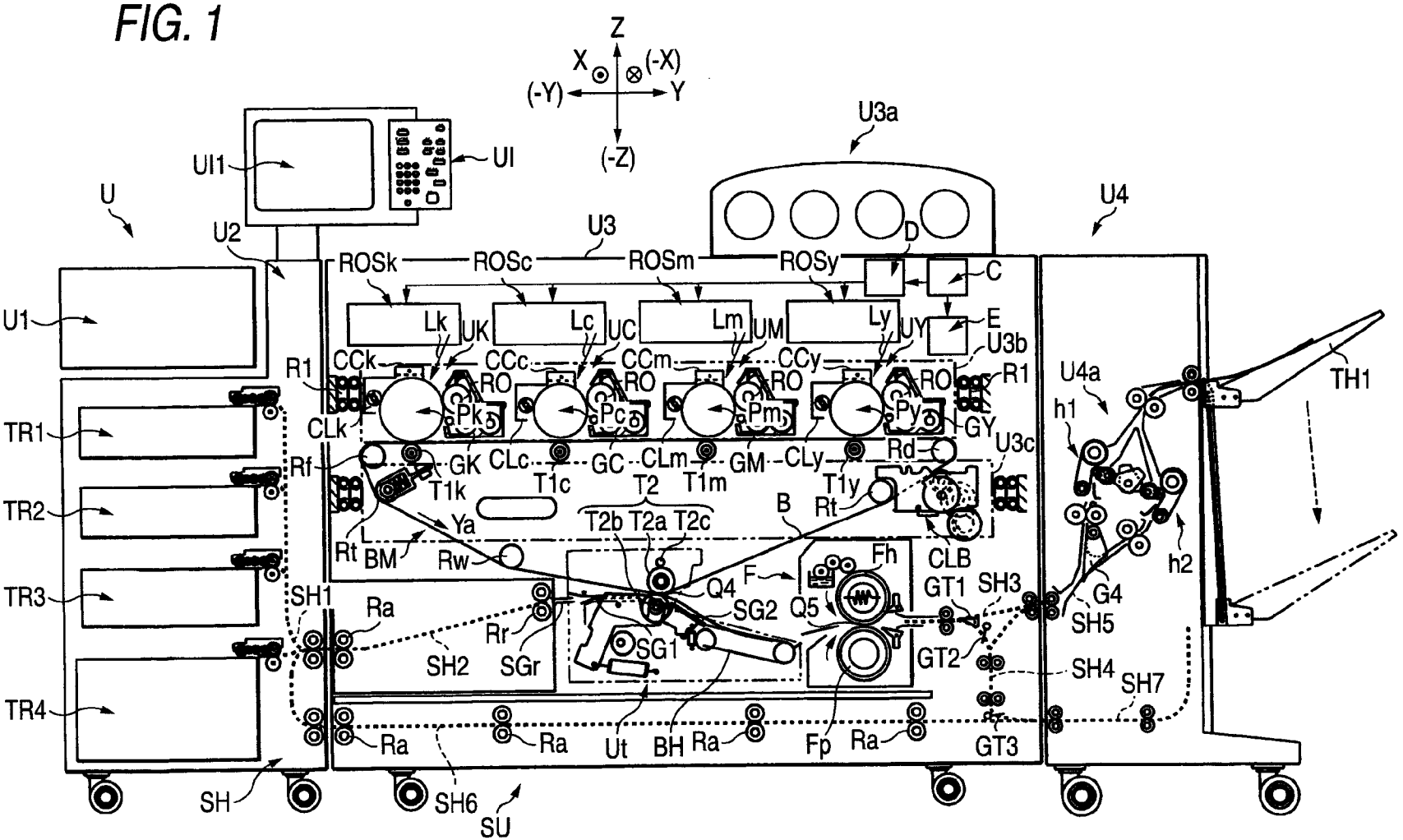
FIG. 1 is a diagram illustrating the whole of an image forming apparatus of Example 1 of the invention.

Next, exemplary embodiments (examples) of the invention will be described with reference to the accompany drawings. However, the invention is not restricted to the following examples.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "○" indicates the arrow which is directed from the rear of the sheet to the front, and that in which "x" is written in "○" indicates the arrow which is directed from the front of the sheet to the rear.

EXAMPLE 1

FIG. 1 is a diagram illustrating the whole of an image forming apparatus of Example 1 of the invention.

Referring to FIG. 1, the image forming apparatus U has: a user interface UI which is an example of an operation portion; an image inputting device U1 which is an example of an image information inputting device; a sheet feeding device U2; an image forming apparatus body U3; and a sheet processing device U4.

The user interface UI has input keys such as a copy start key, a copy number setting key, and a numeric keypad, and a display device U11.

The image inputting device U1 is configured by an automatic document feeding device, an image scanner which is an example of an image reading device, etc. Referring to FIG. 1, the image inputting device U1 reads a document which is not shown, converts an image to image information, and supplies the image information to the image forming apparatus body U3.

The sheet feeding device U2 has: sheet feeding trays TR1 to TR4 which are examples of plural sheet feeding portions; a sheet feeding path SH1 which takes out a recording sheet S that is an example of media housed in the sheet feeding trays TR1 to TR4, and which conveys the sheet to the image forming apparatus body U3; etc.

Referring to FIG. 1, the image forming apparatus body U3 has: an image recording portion which records an image onto the recording sheet S conveyed from the sheet feeding device U2; a toner dispenser device U3*a*; a sheet conveying path SH2; a sheet discharging path SH3; a sheet inverting path SH4; a sheet circulating path SH6; etc. The image recording portion will be described later.

The image forming apparatus body U3 further has: a controlling portion C; a laser driving circuit D which is an example of a latent-image writing device driving circuit that is controlled by the controlling portion C; a power source circuit E which is controlled by the controlling portion C; and the like. The laser driving circuit D the operation of which is controlled by the controlling portion C supplies laser driving signals respectively corresponding to image information of Y (yellow), M (magenta), C (cyan), and K (black) supplied from the image inputting device U1, at a predetermined timing to latent-image forming devices ROSy, ROSm, ROSc, ROSk for respective colors.

Below the latent-image forming devices ROSy, ROSm, ROSc, ROSk for respective colors, a drawer member U3*b* for an image forming unit is supported by a pair of right and left guiding members R1, R1 so as be movable between a drawn-out position where the member is draw out to the front of the image forming apparatus body U3, and an attached position where the member is attached into the image forming apparatus body U3.

Figure 2:
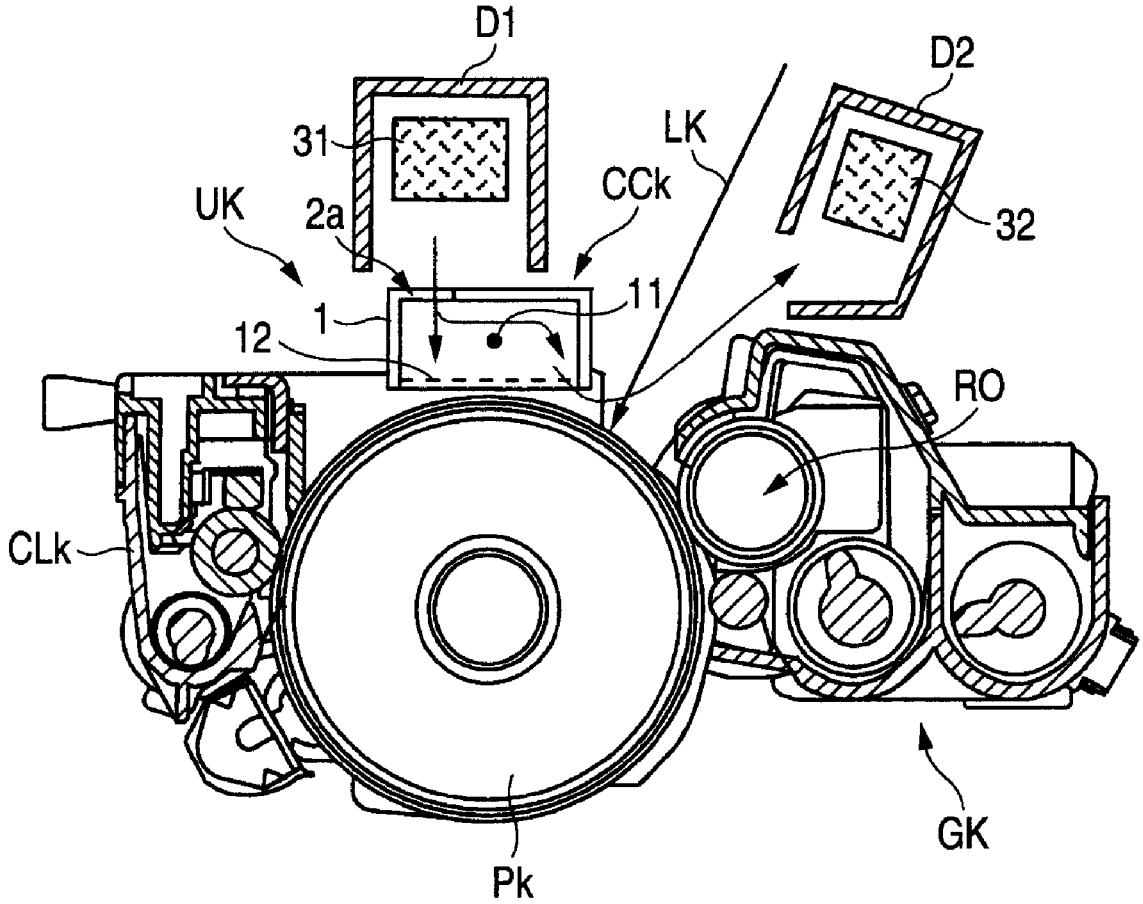
FIG. 2 is a diagram of a visible-image forming device having an image carrier unit and a developing device.

FIG. 2 is a diagram of a visible-image forming device having an image carrier unit and a developing device.

Referring to FIGS. 1 and 2, the image carrier unit UK for black has a photosensitive drum Pk which is an example of an image carrier, a charging device CCk, and an image-carrier cleaner CLk which is an example of an image-carrier cleaning device. In Example 1, the cleaner CLk is configured by a cleaner unit. Also the image carrier units UY, UM, UC for the other colors (Y, M, and C) have photosensitive drums Py, Pm, Pc, charging devices CCy, CCm, CCc which are examples of a discharger, and cleaners CLy, CLm, CLc, respectively. In Example 1, the photosensitive drum Pk for black which is frequently used, and in which therefore the surface is largely worn has a larger diameter than the photosensitive drums Py, Pm, Pc for the other colors, so that the drum can be rotated at a higher speed and the life period is prolonged.

Toner image forming members (UY+GY), (UM+GM), (UC+GC), (UK+GK) are configured by the image carrier units UY, UM, UC, UK and developing devices GY, GM, GC, GK having a developing roll R0 (see FIG. 2), respectively. The image carrier units UY, UM, UC, UK and the developing devices GY, GM, GC, GK are detachably attached to the image forming unit drawer member U3*b* (see FIG. 1).

Referring to FIG. 1, the photosensitive drums Py, Pm, Pc, Pk are uniformly charged by the charging devices CCy, CCm, CCc, CCk, and then electrostatic latent images are formed on the surfaces of the drums by laser beams Ly, Lm, Lc, Lk which are examples of latent-image writing light output from the latent-image forming devices ROSy, ROSm, ROSc, ROSk, respectively. The electrostatic latent images on the surfaces of the photosensitive drums Py, Pm, Pc, Pk are developed to toner images of the colors or Y (yellow), M (magenta), C (cyan), and K (black) by the developing devices GY, GM, GC, GK, respectively.

The toner images on the surfaces of the photosensitive drums Py, Pm, Pc, Pk are sequentially transferred by primary transferring rolls T1*y*, T1*m*, T1*c*, T1*k* which are an example of a primary transferring roll, in an overlapping manner onto an intermediate transfer belt B which is an example of an intermediate transferring member, to form a multi-color image, or a so-called full-color image on the intermediate transfer belt B. The color image formed on the intermediate transfer belt B is conveyed to a secondary transferring region (image forming position) Q4.

Below the image forming unit drawer member U3*b*, an intermediate-transferring member drawer member U3C is supported so as be movable between a drawn-out position where the member is draw out to the front of the image forming apparatus body U3, and an attached position where the member is attached into the image forming apparatus body U3. A belt module BM which is an example of an intermediate transferring device is supported by the intermediate-transferring member drawer member U3C so as to be elevatable between an elevated position where the belt module is in contact with the lower faces of the photosensitive drums Py, Pm, Pc, Pk, and a lowered position where the belt module is downward separated from the lower faces.

The belt module BM has the intermediate transfer belt B, a belt supporting roll (Rd, Rt, Rw, Rf, T2*a*) which is an example of an intermediate-transfer member supporting member, and the primary transferring rolls T1*y*, T1*m*, T1*c*, T1*k*. The belt supporting roll (Rd, Rt, Rw, Rf, T2*a*) has: a belt driving roll Rd which is an example of an intermediate-transfer member driving member; a tension roll Rt which is an example of a tension applying member; a walking roll Rw which is an example of a meandering preventing member; plural idler rolls Rf which are an example of a driven member; and a backup roll T2*a* which is an example of a secondary transfer opposing member. The intermediate transfer belt B is supported by the belt supporting roll (Rd, Rt, Rw, Rf, T2*a*) so as to be rotatably movably rotated in the direction of the arrow Ya.

A secondary transferring unit Ut is placed below the backup roll T2*a*. A secondary transferring roll T2*b* which is an example of a secondary transferring member of the secondary transferring unit Ut is placed so as to be contactable with and separable from the backup roll T2*a* across the intermediate transfer belt B. The secondary transferring region Q4 is formed by a region where the secondary transferring roll T2*b* is pressingly contacted with the intermediate transfer belt B. A contact roll T2*c* which is an example of a voltage applying contacting member butts against the backup roll T2*a*. A secondary transferring device T2 is configured by the rolls T2*a* to T2*c*.

A secondary transfer voltage having the same polarity as the charging polarity of the toner is applied to the contact roll T2*c* at a predetermined timing by the power source circuit which is controlled by the controlling portion C.

The sheet conveying path SH2 is placed below the belt module BM. The recording sheet S fed through the sheet feeding path SH1 of the sheet feeding device U2 is conveyed to the sheet conveying path SH2, and then conveyed by a registration roll Rr which is an example a sheet supply timing adjusting member, to the secondary transferring region Q4 through a medium guiding member SGr and a pre-transfer medium guiding member SG2 in timing with the movement of the toner image to the secondary transferring region Q4.

The medium guiding member SGr is fixed together with a registration roll Rr to the image forming apparatus body U3.

When the toner image on the intermediate transfer belt B is passed through the secondary transferring region Q4, the toner image is transferred to the recording sheet S by the secondary transferring device T2. In the case of a full-color image, toner images which are overlappingly primary-transferred to the surface of the intermediate transfer belt B are collectively secondary-transferred to the recording sheet S.

After the secondary transfer, the intermediate transfer belt B is cleaned by a belt cleaner CLB which is an example of an intermediate-transfer member cleaning device. The secondary transferring roll T2*b* and the belt cleaner CLB are supported so as to be contactable with and separable from the intermediate transfer belt B.

The transferring device (T1+B+T2+CLB) which transfers images on the surfaces of the photosensitive drums Py to Pk to the recording sheet S is configured by the primary transferring rolls T1*y*, T1*m*, T1*c*, T1*k*, the intermediate transfer belt B, the secondary transferring device T2, the belt cleaner CLB, etc.

The recording sheet S to which the toner image has been secondary-transferred is conveyed to a fixing device F through a post-transfer medium guiding member SG2, and a sheet conveying belt BH which is an example of a pre-fixing medium guiding member. The fixing device F has a heating roll Fh which is an example of a heat fixing member, and a pressurizing roll Fp which is an example of a pressurizing fixing member. A fixing region Q5 is formed by a region where the heating roll Fh and the pressurizing roll Fp are pressingly contacted with each other.

When the toner image on the recording sheet S is passed through the fixing region Q5, the toner image is heat-fixed by the fixing device F. A conveying path switching member GT1 is placed on the downstream side of the fixing device F. The conveying path switching member GT1 selectively switches a path for the recording sheet S which has been conveyed through the sheet conveying path SH2 and heat-fixed in the fixing region Q5, to one of the sheet discharging path SH3 of the sheet processing device U4, and the sheet inverting path SH4. The sheet S which is conveyed to the sheet discharging path SH3 is conveyed to a sheet conveying path SH5 of the sheet processing device U4.

A curl correcting device U4*a* is placed in a middle of the sheet conveying path SH5. A switching gate G4 which is an example of a conveying path switching member is placed in the sheet conveying path SH5. The switching gate G4 causes the recording sheet S which is conveyed from the sheet discharging path SH3 of the image forming apparatus body U3, to be conveyed to one of first and second curl correcting members h1 and h2 in accordance with the direction of curvature or so-called curl. In the recording sheet S which is conveyed to the first curl correcting member h1 or the second curl correcting member h2, the curl is corrected when the sheet is passed over the member. The recording sheet S in which the curl is corrected is discharged from a discharging roll Rh which is an example of a discharging member, to a discharge tray TH1 which is an example of a discharging portion of the sheet processing device U4 in a state where the image fixing surface of the sheet is upward directed, or the so-called face-up state.

The sheet S which is conveyed toward the sheet inverting path SH4 of the image forming apparatus body U3 by the conveying path switching member GT1 is passed through a conveying direction restricting member configured by an elastic thin film member, or a so-called mylar gate GT2, while pushing aside the restricting member, and then conveyed to the sheet inverting path SH4 of the image forming apparatus body U3.

The sheet circulating path SH6 and a sheet inverting path SH7 are connected to the downstream end of the sheet inverting path SH4 of the image forming apparatus body U3, and a mylar gate GT3 is placed in the connecting portion. The sheet which is conveyed to the sheet inverting path SH4 through the switching gate GT1 is passed through the mylar gate GT3, and conveyed toward the sheet inverting path SH7 of the sheet processing device U4. In the case of double-sided printing, the recording sheet S which is conveyed through the sheet inverting path SH4 is once passed through the mylar gate GT3 to be conveyed to the sheet inverting path SH7, and thereafter reversely conveyed or subjected to the so-called switch-back operation. Then, the conveying direction is restricted by the mylar gate GT3, so that the recording sheet S which is switched back is conveyed toward the sheet circulating path SH6. The recording sheet S which is conveyed to the sheet circulating path SH6 is passed through the sheet feeding path SH1 to be again sent to the transferring region Q4.

By contrast, when the recording sheet S which is conveyed through the sheet inverting path SH4 is switched back after the rear end of the recording sheet S is passed through the mylar gate GT2, and before the sheet is passed through the mylar gate GT3, the direction of conveying the recording sheet S is restricted by the mylar gate GT2, and the recording sheet S is conveyed to the sheet conveying path SH5 in a state where the sides of the sheet are inverted. The inverted recording sheet S is subjected to the curl correction by the curl correcting device U4*a*, and then can be discharged onto the discharge tray TH1 of the sheet processing device U4 in a state where the image fixing surface of the sheet S is downward directed, or the so-called face-down state.

A sheet conveying path SH is configured by the components denoted by the reference characters SH1 to SH7. A sheet conveying device SU is configured by the components denoted by the reference characters SH, Ra, Rr, Rh, SGr, SG1, SG2, and GT1 to GT3.

(Description of Charging Device)

Figure 3:
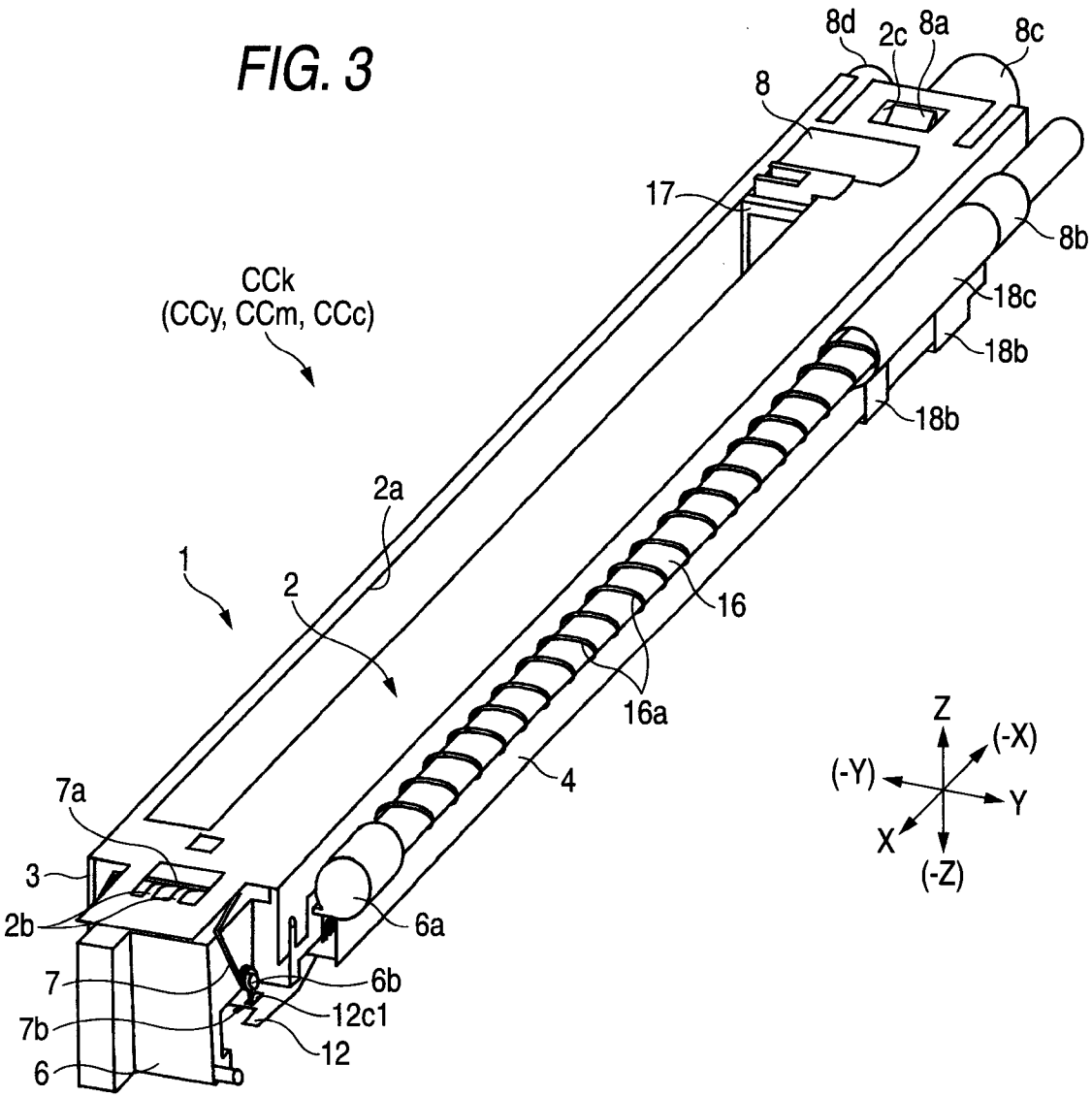
FIG. 3 is a perspective view illustrating a charging device of Example 1 of the invention.

FIG. 3 is a perspective view illustrating the charging device of Example 1 of the invention.

Figure 4A:
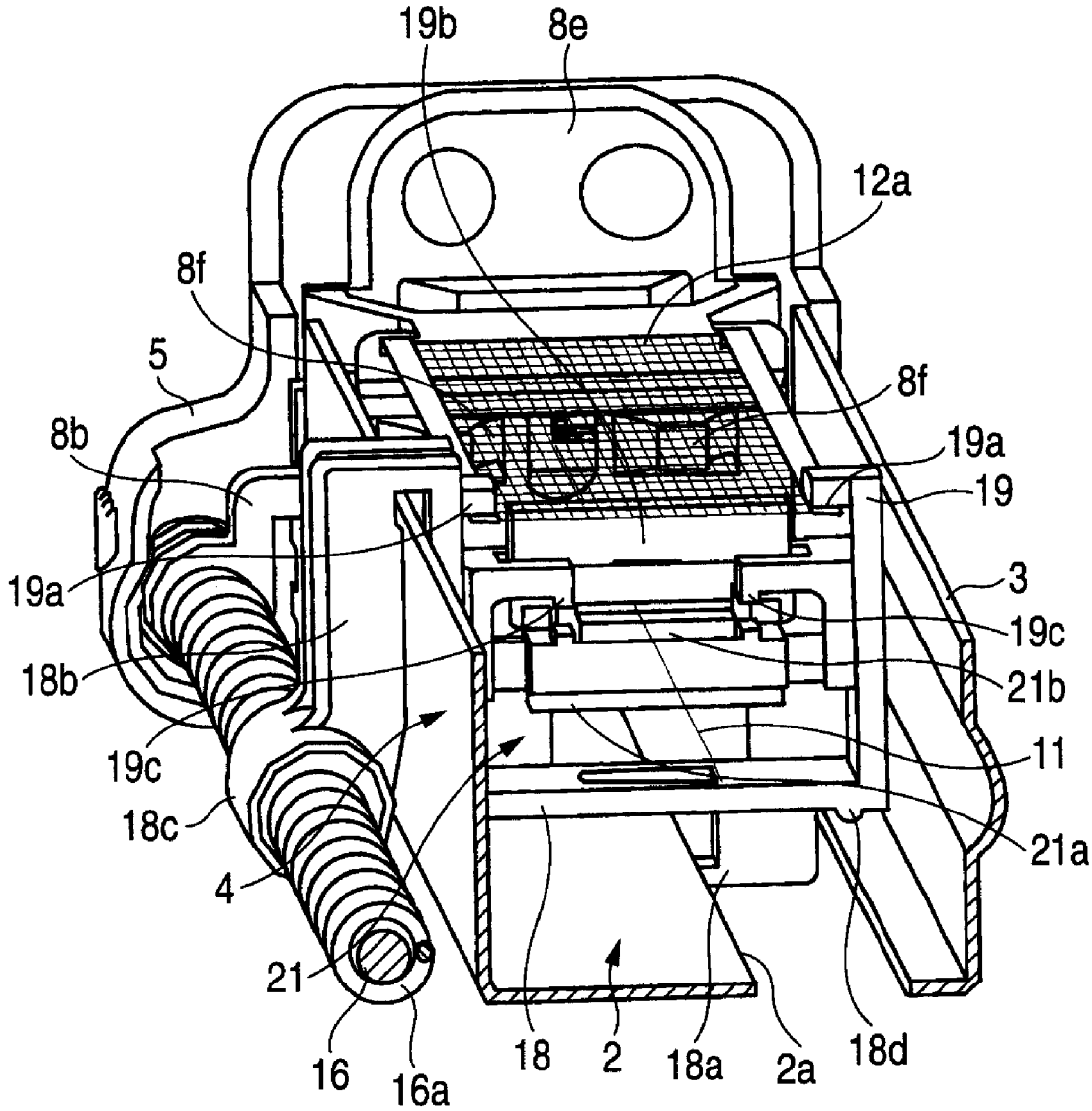
Figure 4B:
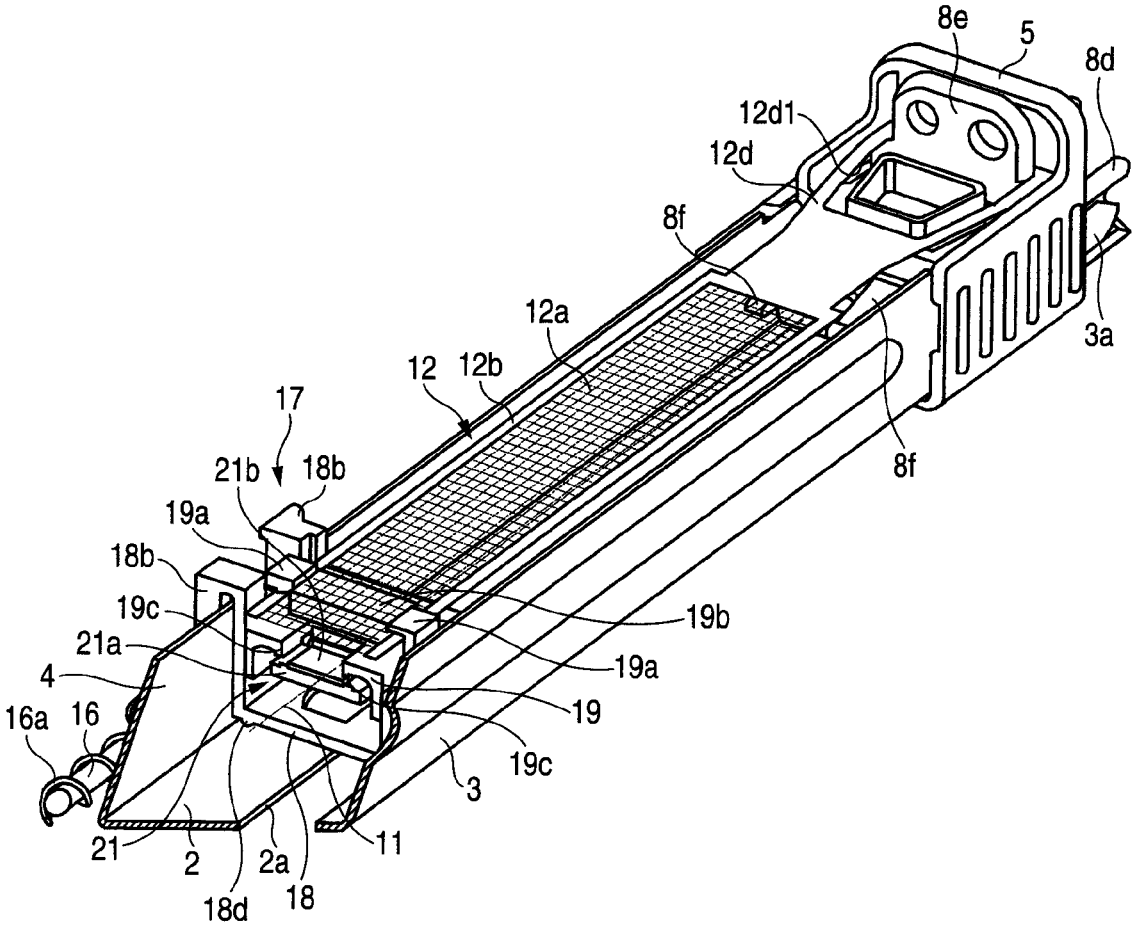

FIG. 4 is a section diagram of main portions of the charging device of Example 1 of the invention in which FIG. 4A is a view illustrating main portions of the right side of the charging device, and FIG. 4B is a view illustrating main portions of the left side of the charging device.

Referring to FIGS. 3 and 4, each of the charging devices CCy to CCk of Example 1 has a shield electrode 1 which is an example of a surrounding electrode member that extends in the front and rear directions, and that has a U-like shape where the portion on the side of the photosensitive drums Pm to Pk is opened. The shield electrode 1 has an upper wall 2, and left and right side walls 3, 4 which downward extend from left and right sides of the upper wall 2.

An air supply port 2*a* which extends in the front and rear directions is formed in the left side of the upper wall 2. A spring claw portion 2*b* is formed in a front end portion of the upper wall 2, and an end-member locking hole 2*c* is formed in rear end portion. Referring to FIG. 4B, an opposed-electrode terminal 3*a* is formed in a rear end portion of the left side wall 3, and a predetermined opposed-electrode voltage is applied to the terminal from the power source circuit E of the image forming apparatus U. In FIG. 3, the charging devices CCy to CCk are shown in a state where a rear cover 5 which is an example of an attachment protection member is detached.

Referring to FIG. 3, a front end member 6 is fixedly supported on a front end portion of the shield electrode 1. A front rotation shaft supporting portion 6*a* which is rightward projected is formed on the right side of a rear end portion of the front end member 6. A pair of spring attaching portions 6*b* which are projected toward the right and left outer sides are formed in the front side of the front end member 6. In FIG. 3, only the right spring attaching portion 6*b* is shown. Net-like electrode stretching springs 7 are attached to the spring attaching portions 6*b*, respectively. Each of the net-like electrode stretching springs 7 has a claw engaging portion 7*a* in an upper portion, and can be engaged with the spring claw portion 2*b* by advancing the claw engaging portion 7*a* into the space between the upper wall 2 and the front end member 6. An electrode claw 7*b* is formed in a lower portion of the net-like electrode stretching spring 7.

Referring to FIGS. 3 and 4, a rear end member 8 is fixedly supported on a rear end portion of the shield electrode 1. The rear end member 8 is fixedly supported on the rear end portion of the shield electrode 1 by: a projecting portion which is not shown, and which is attached to a front movement restricting groove that is formed in the left and right side walls 3, 4, and that is not shown; and a claw member 8*a* which is engaged with the end-member locking hole 2*c*. On the right side of the rear end member 8, a rear rotation shaft supporting portion 8*b* which is rightward projected is formed correspondingly with the front rotation shaft supporting portion 6*a*. A discharge electrode terminal protecting portion 8*c*, and an opposed-electrode terminal protecting portion 8*d* which protects the opposed-electrode terminal 3*a* are rearward projectingly formed in a rear end portion of the rear end member 8. A net-like electrode end supporting portion 8*e* which is downward projected is formed in a lower portion of the rear end member 8. Referring to FIGS. 4A and 4B, a pair of discharge cleaning press canceling portions 8*f* which are projected into the shield electrode 1 are formed on the rear end member 8.

Referring to FIG. 4, between the pair of front and rear end members 6, 8, a discharge electrode member 11 which extends in the front and rear directions is supported in the shield electrode 1 in a stretched state. In Example 1, the discharge electrode member 11 is configured by a tungsten member having a diameter of 40 [μm] and a length of 396.2±0.7 [mm]. The values and the shape can be arbitrarily changed in accordance with the design or the like. For example, an arbitrary material which can be used as a discharge electrode, such as tungsten, molybdenum, tantalum, or gold plating can be used. In the discharge electrode member 11, an electrode terminal which is not shown, and which is housed in the discharge electrode terminal protecting portion 8*c* is disposed in a rear end portion, and a power source is supplied to the terminal from the power source circuit E of the image forming apparatus U. In Example 1, the power source supplied to the discharge electrode member 11 is constant-current controlled so that a current of 700 [−μA] is supplied. The constant-current control or a constant-voltage control can be changed in accordance with the design or the like. Furthermore, also the current value, or a voltage value can be adequately changed.

Figure 5:
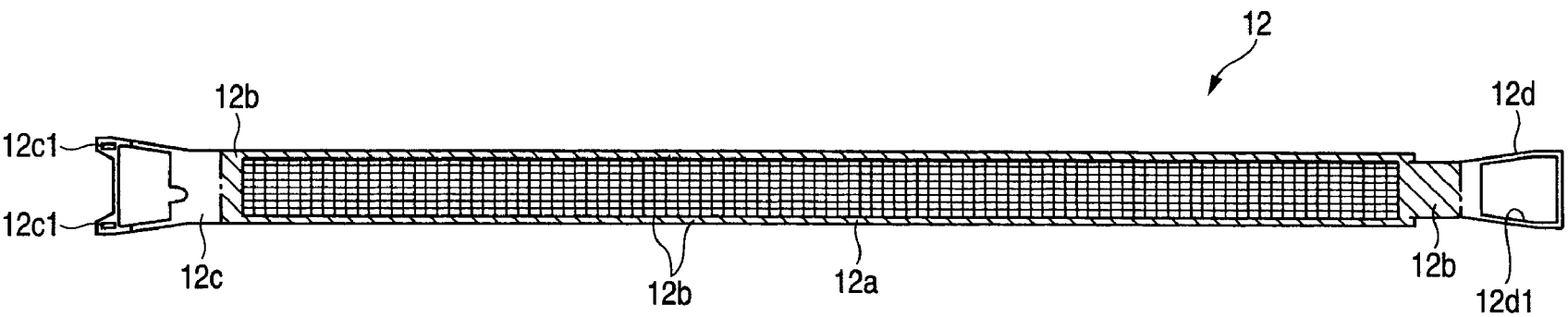
FIG. 5 is a view illustrating a net-like electrode member in Example 1 of the invention.

FIG. 5 is a view illustrating a net-like electrode member in Example 1 of the invention.

Referring to FIGS. 3 to 5, between the end members 6, 8, the net-like electrode member 12 is supported in a lower opening position of the shield electrode 1, i.e., a charging region which is a region opposed to corresponding one of the image carriers Py to Pk. The net-like electrode member 12 has: a central net portion 12*a*; a frame portion 12*b* which surrounds the net portion 12*a*; a front supported portion 12*c* which is formed in the front side of the frame portion 12*b*; and a rear supported portion 12*d* which is formed in the rear side of the frame portion 12*b*. In the front end of the front supported portion 12*c*, a pair of right and left claw engaging holes 12*c*1 are formed correspondingly with the electrode claws 7*b* of the net-like electrode stretching springs 7. The claw engaging holes 12*c*1 in Example 1 function also as an energized portion. An attaching hole 12*d*1 which is to be attached to the net-like electrode end supporting portion 8*e* is formed in the rear supported portion 12*d*. Therefore, the attaching hole 12*d*1 is fixed to the net-like electrode end supporting portion 8*e*, and the net-like electrode member 12 in Example 1 is attached to the net-like electrode stretching springs 7. Consequently, the net-like electrode member is supported by the net-like electrode stretching springs 7 in a state where the member is stretched with a predetermined tension.

The net-like electrode member 12 is electrically connected to the shield electrode 1 through the conductive net-like electrode stretching springs 7. An opposed electrode member (1+12) in Example 1 is configured by the net-like electrode member 12 and the shield electrode 1. In Example 1, although the voltage applied to the opposed electrode member (1+12) is changed and controlled in accordance with the environment such as the temperature and the humidity, an opposed-electrode voltage of about −700 to −800 [V] is applied to the opposed electrode member.

Referring to FIG. 5, the net-like electrode member 12 in Example 1 is configured by stainless steel, and a surface layer of tetrahedral amorphous carbon having a thickness of 0.05 [μm] is formed on or coats the face of the member which is opposed to the discharge electrode member 11. Hereinafter, tetrahedral amorphous carbon is abbreviated as ta-C. In the net-like electrode member 12, the surface layer of ta-C is formed only on the inner faces of the net portion 12*a* and the frame portion 12*b*, i.e., the face which is opposed to the discharge electrode member 11. The ta-C is semiconductive, and, although depending on the thickness, has a volume resistivity of about $10^8$ to $10^{10}$ [Ω·cm]. Namely, the electric resistance is slightly higher than that of a conductor. Therefore, ta-C is formed not on the whole face of the net-like electrode member 12, but on the partial face where problems due to discharge products are significant. In order to prevent the electric resistance of the portions of the claw engaging holes 12*c*1 that are an example of an energized portion through which the power source is supplied to the net-like electrode member 12, from rising, the surface layer of ta-C is not formed on the front supported portion 12*c*.

In the example, the surface layer of ta-C is formed only on the face which is opposed to the discharge electrode member 11. In order to further suppress adhesion and re-emission of discharge products, alternatively, the surface layer may be formed on the both faces of the net-like electrode member 12. In the alternative, the surface layer of ta-C formed on the face which is opposed to the discharge electrode member 11 may be thicker than that of ta-C formed on the face which is opposed to the image carrier Py to Pk. Namely, on the face which is opposed to the discharge electrode member 11, the amount of discharge products is large, and so-called sputtering due to a discharge easily occurs. Therefore, the thickness of the layer must be equal to or larger than predetermined value. In the rear face which is not opposed, by contrast, the amount of discharge products and the burden due to sputtering are small, and hence the thickness can be reduced. Therefore, the time for forming the layer during production, and the amount of the raw materials can be reduced, and the cost can be lowered. In the surface and the rear face, namely, the surface layer of ta-C can have different thicknesses.

A ta-C thin film in which the main structure is configured by an SP3 structure by a carbon atom is formed on the net-like electrode member 12 in the following manner. A carbon atom, or a carbon atom and another desired atom or other desired plural atoms are formed into a plasma, and ionized atoms adhere to the surface of the net-like electrode member 12, thereby forming the thin film. From the viewpoints of conductivity and wear resistance, preferably, the rate of the SP3 structure is about 40% to 85%. For example, the process of forming the thin film may be performed by the FCVA technique, i.e., the Filtered Cathodic Vacuum Arc Technology. Conventionally, the FCVA technique is known in, for example, JP-A-2001-195717 in which a wear-resistant film is formed on, although not a charging device, a magnetic disk, or JP-A-2005-173141 in which a wear-resistant film is formed on the surface of a developing roll. Therefore, its detailed description is omitted.

Referring to FIGS. 3 and 4, in the right outer portion of the shield electrode 1, a rotation shaft 16 which extends in the front and rear directions is rotatably supported between the pair of front and rear rotation shaft supporting portions 6*a*, 8*b*. A rear portion of the rotation shaft 16 rearward extends while passing through the rear rotation shaft supporting portion 8*b*. A gear which is not shown is attached to a rear end portion, and rotation is transmitted to the gear from a motor which is not shown. A helical screw thread 16*a* is formed on the outer circumference of the rotation shaft 16.

An electrode cleaning member 17 is housed inside the shield electrode 1 and the net-like electrode member 12. The electrode cleaning member 17 has: a cleaning member body 18; a net-like electrode cleaner 19 which is fixedly supported on the cleaning member body 18; and a discharge electrode cleaner 21 which is movably supported on the cleaning member body 18. The cleaning member body 18 has: an upper-wall clamping portion 18*a* which is placed on an upper portion through the air supply port 2*a*, and which has a shape of clamping the upper wall 2; and a movement transmitting portion 18*b* which downward extends through a gap between the right side wall 4 and the frame portion 12*b* of the net-like electrode member 12, and which further extends round the right side wall 4 to the rotation shaft 16. A screw fitting portion 18*c* which is screw-fitted to the screw thread 16*a* of the rotation shaft 16 is formed in the tip end of the movement transmitting portion 18*b*. Referring to FIG. 4, in the cleaning member body 18, a contact projection 18*d* for reducing a friction resistance is formed between the body and the upper wall 2.

The net-like electrode cleaner 19 has: frame clamping portions 19*a* which clamp the frame portion 12*b* of the net-like electrode member 12; and net-like electrode cleaning portions 19*b* which are in contact with the inner face of the net-like electrode member 12. The net-like electrode cleaning portion 19*b* are configured by a cleaning brush in which many cleaning bristles are embedded. Position restricting portions 19*c* which are downward projected are formed below the net-like electrode cleaning portions 19*b*.

The discharge electrode cleaner 21 which is placed below the position restricting portions 19*c* has: a discharge-electrode cleaner body 21*a*; and a discharge-electrode cleaning portion 21*b* which is supported by the discharge-electrode cleaner body 21*a*, and which is in contact with and cleans the discharge electrode member 11. The discharge-electrode cleaning portion 21*b* in Example 1 is configured by a cloth-like material. The discharge-electrode cleaner body 21*a* is urged by a spring which is not shown, in a direction along which the discharge-electrode cleaning portion 21*b* is pressed against the discharge electrode member 11. The position of the discharge-electrode cleaner body 21*a* is restricted by the position restricting portions 19*c*, and the discharge-electrode cleaning portion 21*b* is pressed against the discharge electrode member 11 by a predetermined force.

When the rotation shaft 16 is rotated forwardly or reversely, therefore, the movement transmitting portion 18*b* is moved forwardly or rearwardly, and the electrode cleaning member 17 is moved forwardly or rearwardly while being guided by the upper-wall clamping portion 18*a* and the frame clamping portions 19*a*. In accordance with the movement of the electrode cleaning member 17, the net-like electrode member 12 and the discharge electrode member 11 are cleaned by the net-like electrode cleaning portions 19*b* and the discharge-electrode cleaning portion 21*b*. Example 1 is configured so that, after every printing of 5,000 sheets, or 5 kPV, the motor is driven to automatically perform the cleaning operation by the electrode cleaning member 17.

In Example 1, in a state where the electrode cleaning member 17 is moved to a waiting position shown in FIG. 3, the discharge cleaning press canceling portions 8*f* of the rear end member 8 advances between the discharge-electrode cleaner body 21*a* and the position restricting portions 19*c* to hold a state where the discharge-electrode cleaning portion 21*b* is separated from the discharge electrode member 11. When the electrode cleaning member 17 is forward moved, the discharge cleaning press canceling portions 8*f* is separated from between the discharge-electrode cleaner body 21*a* and the position restricting portions 19*c*. In the case where the operation of cleaning the electrodes 11, 12 is ended and the image forming operation is to be performed, when the electrode cleaning member is moved to the waiting position, therefore, the discharge electrode member 11 is set to a predetermined position to enable a stabilized discharge, and, during the cleaning operation, the discharge cleaning press canceling portions 8*f* is separated, and the discharge-electrode cleaning portion 21*b* is pressed against the discharge electrode member 11 to perform the cleaning operation.

Referring to FIG. 2, in the image forming apparatus U of Example 1, a first air flow path D1 having an air outflow port 31 is placed above corresponding one of the charging devices CCy to CCk, and a second air flow path D2 having an air discharge port 32 is placed above corresponding one of the developing devices GY to GK. An air blower which is an example of a gas transfer device that is not shown is placed inside the image forming apparatus U. The air which flows out from the air outflow port 31 passes through the interior of the charging device CCy to CCk via the air supply port 2*a*, then flows into the air discharge port 32 to be cleaned by a cleaner or a so-called filter, and is discharged to the outside. In Example 1, in order to enable the air in the charging device CCy to CCk to be efficiently replaced, the air supply port 2*a* is formed in the left side which is remote from the air discharge port 32. In the case where the air supply port 2*a* is formed in the right side, the air of the left side of the interior of the charging device CCy to CCk stays and is hardly replaced. By contrast, in the case where the air supply port is formed in the left side, an efficient replacement of the air is realized.

(Function of Example 1)

In the image forming apparatus U of Example 1 having the above-described configuration, when voltages are applied to the discharge electrode member 11 and the opposed electrode member (1+12) to generate a potential difference, a discharge occurs and the surface of the photosensitive drum Py to Pk is charged. In Example 1, charges are uniformly supplied to the photosensitive drum Py to Pk by the net-like electrode member 12, and the drum is uniformly charged.

During the discharging process in the charging device CCy to CCk, discharge products such as ozone $O_3$ and a nitrogen oxide $NO_x$ is produced in the charging device CCy to CCk. The discharge products adhere to the shield electrode 1 and the net-like electrode member 12 or react with the net-like electrode member 12 to produce a metal oxide, or so-called rust. When the oxide adheres or rust is produced, there is the possibility that an abnormality occurs in the charging property, because the oxide is an insulator. When rust is produced in the net-like electrode member 12, particularly, the ability of uniformizing the charging is lowered. In Example 1, by contrast, the surface layer of ta-C which is oxidation resistant and low in reactivity reduces the occurrence of rust in the net-like electrode member 12. At this time, when the air is supplied from the air supply port 2*a* to the charging device CCy to CCk and the inside air is replaced, discharge products in the charging device CCy to CCk, and those which adheres to the net-like electrode member 12, and which do not react therewith are discharged together with the air.

EXPERIMENTAL EXAMPLES

Hereinafter, results of experiments which are performed on the basis of the configuration of Example 1 will be described.

Experiment 1

In Experiment 1, with respect to the conventional example in which a surface layer of ta-C is not disposed, it is checked whether a streak-like image defect due to a charge failure in the sub-scanning direction occurs or not.

First, with respect to the conventional technique in which a surface layer of ta-C is not disposed, experiments in which a half-tone image is printed with using DC5000 manufactured by Fuji Xerox Co., Ltd. are performed. In Comparative example 1, the experiment is performed only in a medium temperature/low humidity environment of 21° C. and 10% RH. In Comparative examples 2, 3, and 4, the experiment is performed with using the same apparatus and in various environments while the time and place are changed. The environments in which the experiments of Comparative examples 2 to 4 are a high temperature/high humidity environment of 28° C. and 85% RH (hereinafter, referred to as "A Zone"), a medium temperature/medium humidity environment of 22° C. and 55% RH (hereinafter, referred to as "B Zone"), a low temperature/low humidity environment of 10° C. and 15% RH (hereinafter, referred to as "C Zone"), and a medium temperature/low humidity environment of 21° C. and 10% RH (hereinafter, referred to as "J Zone"). Namely, it can be deemed that the experiments of Comparative examples 1 to 4 are performed in order to increase the number of experimental data in the environments.

As Comparative example 5, an experiment is performed in which printing is conducted in J Zone, the environment is changed to C Zone when the degree of an image defect, or the grade becomes 2.5, and the variation of the grade caused by the environment change is checked.

In Comparative examples 1 to 5, a white streak appearing in an image, i.e., a streak-like image defect is checked by visual inspection, thereby evaluating the grade. In the case where such a defect is not observed, i.e., the image quality does not deteriorate, it is evaluated as grade 0. As a white streak is more conspicuous, i.e., as the image quality is worse, a higher grade is set. The evaluation is performed at the step of 0.5. When the grade is 2.0 or less, the image quality is determined acceptable, and, when the grade is 2.5 or more, the image quality is determined unacceptable. The experiment is performed while, as temporary conditions, the life period of the charging device is set to 200 kPV. FIG. 6 shows experimental results.

Figure 6A:
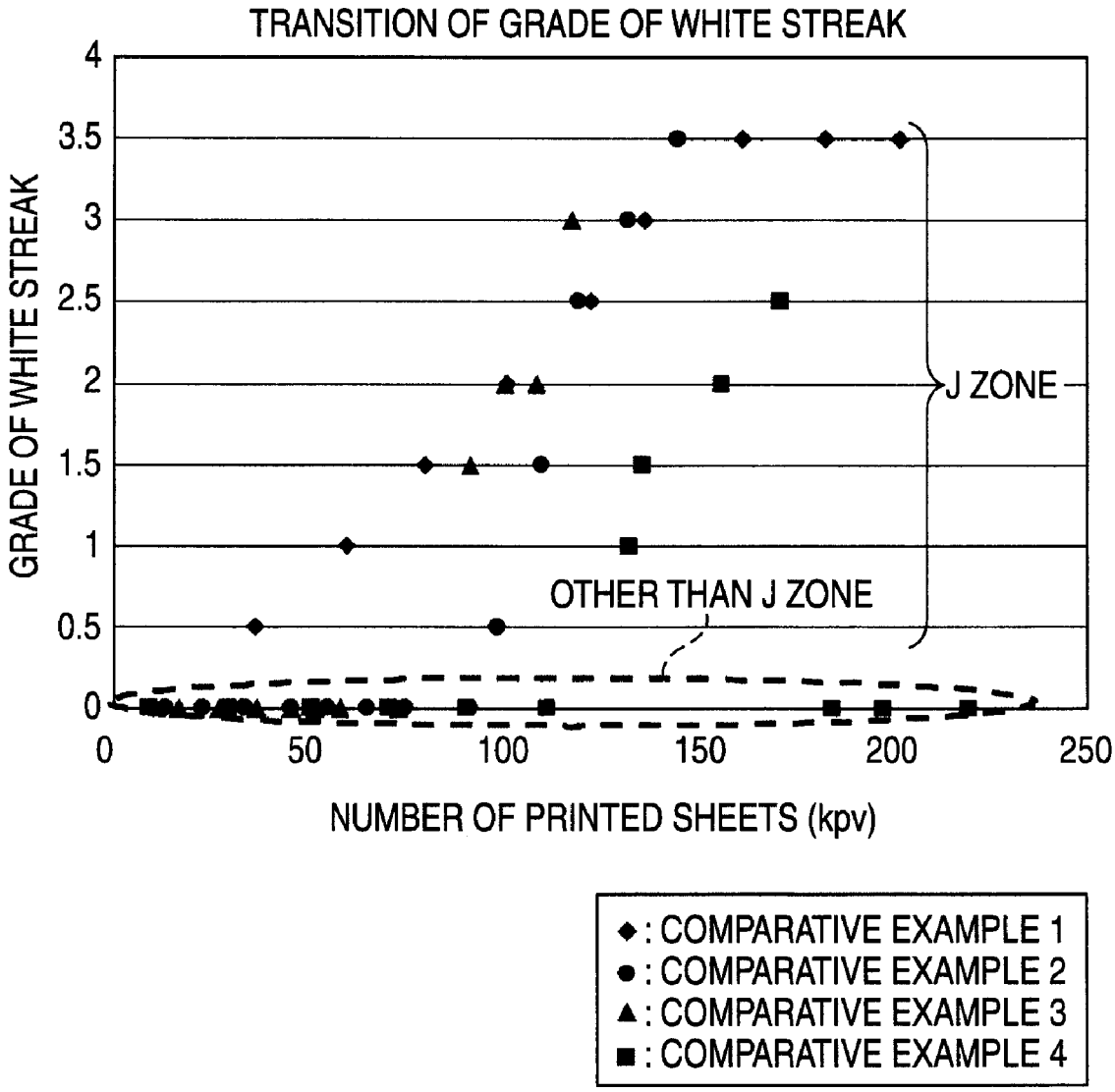
Figure 6B:
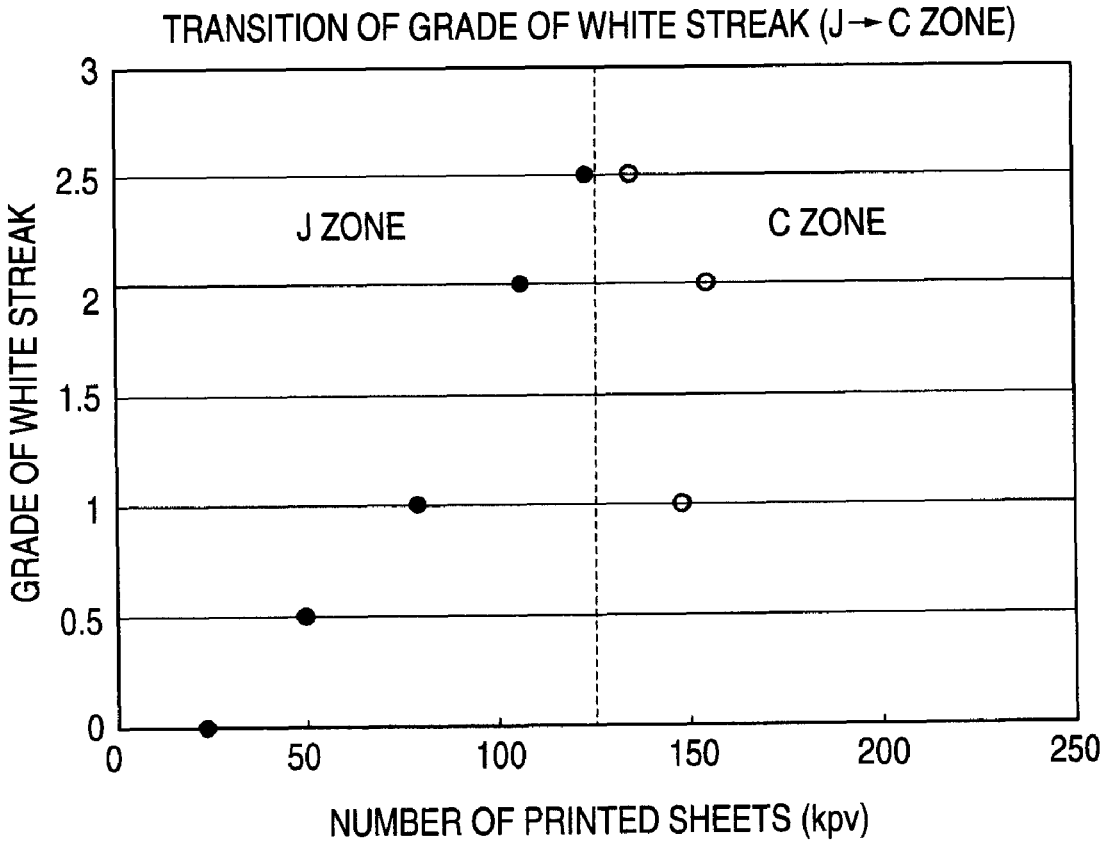

FIG. 6 is a view showing experimental results of Experiment 1 in Example 1. FIG. 6A is a graph of experimental results of Comparative examples 1 to 4 in which the abscissa indicates the number of printed sheets and the ordinate indicates the grade of a white streak, and FIG. 6B is a graph of experimental results of Comparative example 5 in which the abscissa indicates the number of printed sheets and the ordinate indicates the grade of a white streak.

Referring to FIG. 6A, from the results of Comparative examples 1 to 4, it is confirmed that, in the conventional technique in which a surface layer of ta-C is not disposed, an image defect of a white streak is not produced in A Zone, B Zone, and C Zone, but, in J Zone, an image defect of a white streak is produced and the grade is worse as the number of printed sheets is larger. In this case, the surface potential VH of the photosensitive drum Py to Pk in the portion where a white streak is produced is measured, and it is confirmed that the potential is higher by 20 to 30 V than the surface potential of a portion where a white streak is not produced. It is estimated that this is caused by a phenomenon in which, during a discharge, the surface of the net-like electrode member 12 is made insulative by oxidation due to discharge products and the like, or adhesion of an external additive contained in a developer, and, in a position corresponding to the place where insulation is made higher, the surface potential VH is raised.

From the results of Comparative example 5, it is noted that, when only J Zone is used, printing of 100 kPV or 100,000 sheets is unacceptable, and it is confirmed that, even when the environment is changed to C Zone after occurrence of an image defect of a white streak, neither improvement nor degradation is observed. From the results of Comparative example 4 shown in FIG. 6A, in the case where the environment is changed from J Zone to A Zone or B Zone, a white streak is not produced, or the grade 0 is attained after the change to A Zone or B Zone. From the above, it is confirmed that an image defect of a white streak easily occurs particularly in J Zone.

FIG. 7 is a view showing experimental results of Experimental example 2.

Experiment 2

In Experiment 2, experiments in which, from the results of Experiment 1 above, a method of improving a white streak is studied are performed. In Comparative examples 6 to 11 and Experimental example 1 below, in the same manner as Experiment 1 above, experiments in which a half-tone image is printed with using DC5000 manufactured by Fuji Xerox Co., Ltd. are performed.

In Comparative example 6, the interval of cleaning by the electrode cleaning member 17 is set to from 5 kPV to 3 kPV, so that the electrode members 1, 11, 12 are frequently cleaned. At the timing of 120 kPV in J Zone, however, the grade is 2.5, and an improvement effect is not observed as compared with Comparative examples 1 to 5.

In Comparative example 7, the amount of biting of the cleaning brush, i.e., the brushes of the net-like electrode cleaning portions 19*b* into the net-like electrode member 12 is increased by 0.5 mm, so that the cleaning performance is enhanced. At the timing of 50 kPV, however, the grade is 2.0 to 2.5, and an improvement effect is not observed as compared with Comparative examples 1 to 5.

In Comparative example 8, in addition to the cleaning brush, a polishing sheet is added to the net-like electrode cleaning portions 19*b*, so that the cleaning performance is enhanced. At the timing of 50 kPV, however, the grade is 2.0 to 2.5, and an improvement effect is not observed as compared with Comparative examples 1 to 5.

In Comparative example 9, without changing the amount of the air supplied from the air outflow port 31, the amount of the air discharged through the air discharge port 32 is set to ½. At the timing of 100 kPV, however, the grade is 2.5, and an improvement effect is not observed as compared with Comparative examples 1 to 5.

In Comparative example 10, a sealing member is disposed on the upstream side of the developing device GY to GK to prevent the developer from flowing from the developing device GY to GK. At the timing of 50 kPV, however, the grade is 2.0, and an improvement effect is not observed as compared with Comparative examples 1 to 5. In Comparative example 10, however, the grade is improved only in the rear side, but there arises a problem in that the difference in image density in the front and rear direction or the scanning direction becomes larger.

In Comparative example 11, the shape of the first air flow path D1 is changed to reduce the dispersion of the air flow rate in the front and rear directions from the previous dispersion in which the minimum is 0.04 m/s and the maximum is 0.6 m/s, to the dispersion in which the minimum is 0.33 m/s and the maximum is 0.68 m/s. At the timing of 50 kPV, however, the grade is 1.5, or slightly improved as compared with Comparative examples 1 to 5. In Comparative example 11, the grade is wrong only in the rear side, and the grade is improved in the middle side.

In Experimental example 1, the surface layer of ta-C is formed on the surface of the net-like electrode member 12 on the side of the discharge electrode member 11, thereby enhancing the antirust property. In this case, even when printing of 206 kPV is performed in J Zone, the grade is 0 to 0.5, and a large improvement effect is observed as compared with Comparative examples 1 to 5.

Experiment 3

Figure 8B:
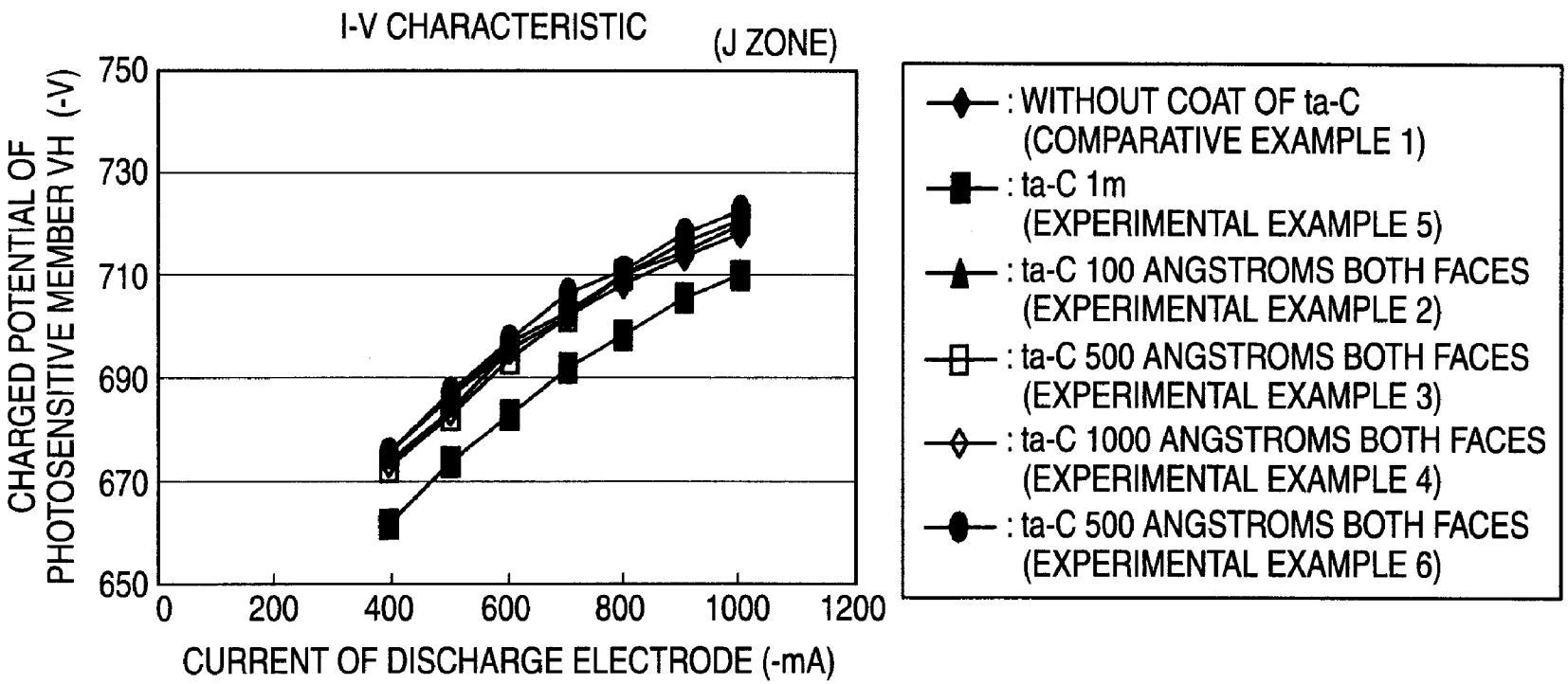

In Experiment 3, experiments for studying an appropriate value of the thickness of the surface layer of ta-C formed on the net-like electrode member 12 are performed. The experiments are performed on: relationships among the thickness of ta-C, the value of the current supplied to the discharge electrode member 11, and the charged potential VH of the surface of the photosensitive drum Py to Pk; the mechanical strength of the surface layer against rubbing by the electrode cleaning member 17 at every 5 kPV; and occurrence of a white streak in the case where a half-tone image is printed with using above-mentioned DC5000 and in J Zone. In Experimental example 2, the thickness of the layer is set to 100 angstroms=10 nm. In Experimental example 3, the thickness is set to 500 angstroms=50 nm. In Experimental example 4, the thickness is set to 1,000 angstroms=0.1 μm. In Experimental example 5, the thickness is set to 10,000 angstroms=1 μm. FIG. 8A shows results of the experiments. With respect to relationships between the value of the current supplied to the discharge electrode member 11, and the charged potential VH of the surface of the photosensitive drum Py to Pk, in addition to Experimental examples 2 to 5, an experiment on a configuration in which the surface layer of ta-C of 500 angstroms=50 nm is formed on the both faces of the net-like electrode member 12 is performed as Experimental example 6. FIG. 8B shows a result of the experiment.

FIG. 8 is a view showing experimental results of Experiment 3 in which FIG. 8A shows a list of the experimental results, and FIG. 8B is a graph showing experimental results of electric performances.

Referring to FIG. 8A, from the experimental results of Experimental examples 2 to 4, the followings are confirmed. When the film thickness of ta-C having a larger volume resistivity than a conductor is 100 to 1,000 angstroms, the charged potential VH of the surface of the photosensitive drum Py to Pk can be made approximately equal to that of Comparative example 1 in which a surface layer of ta-C is not formed. The other members can be incorporated as they are without performing a design change and the like. Furthermore, it is confirmed that, because of the net-like electrode cleaning portions 19*b*, the mechanical strength of the surface layer against rubbing is high, and peeling, breakage, and the like of the surface layer are not produced as compared with the case of gold plating, etc. Moreover, it is confirmed that, in J Zone, a white streak does not occur even when operations of 200 kPV or more which is equal to the product life period are performed. In Experimental example 4, experiments using an actual apparatus are omitted.

Referring to FIGS. 8A and 8B, in Experimental example 5, it is confirmed that the resistance is large because the layer of ta-C is excessively thick, and the surface potential VH of the photosensitive drum Py to Pk is lowered by about 10 V. However, there is no problem in mechanical strength and occurrence of a white streak. In Experimental example 5, namely, it is confirmed that occurrence of a white streak can be prevented from occurring, by controlling the power source circuit E so that the surface potential VH is higher by 10 V than the conventional case.

Referring to FIGS. 8A and 8B, in Experimental example 6, it is confirmed that electrical properties which are similar to those of Experimental examples 2 to 4 are obtained. Discharge products easily adhere to the surface on the side of the discharge electrode member 11. Even when the ta-C layer is formed on the both faces, therefore, mechanical properties are same as the results of Experimental example 3 because the net-like electrode cleaning portions 19*b* are placed on the side of the upper face. Also in the case where an actual apparatus is used, the same results are obtained.

EXAMPLE 2

Next, Example 2 of the invention will be described. In the description of Example 2, the components corresponding to those of Example 1 are denoted by the same reference numerals, and their detailed description is omitted.

Example 2 is configured in the same manner as Example 1 except following point.

Each of the charging devices CCy to CCk in Example 2 is configured in the same manner as those of Example 1 except that the surface layer of ta-C is formed also on the inner face of the shield electrode 1 in addition to the net-like electrode member 12.

(Function of Example 2)

Figure 9A:
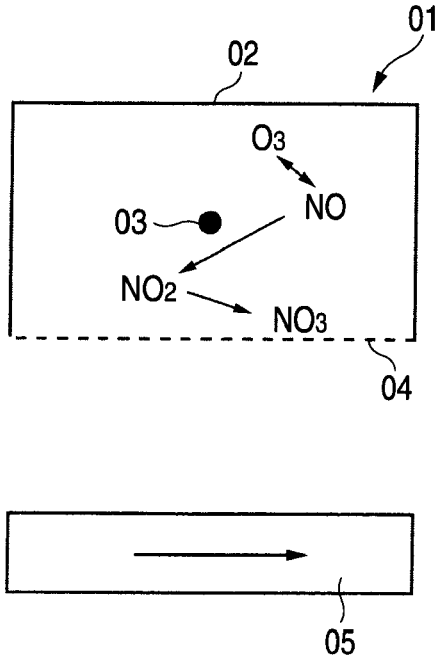
Figure 9B:
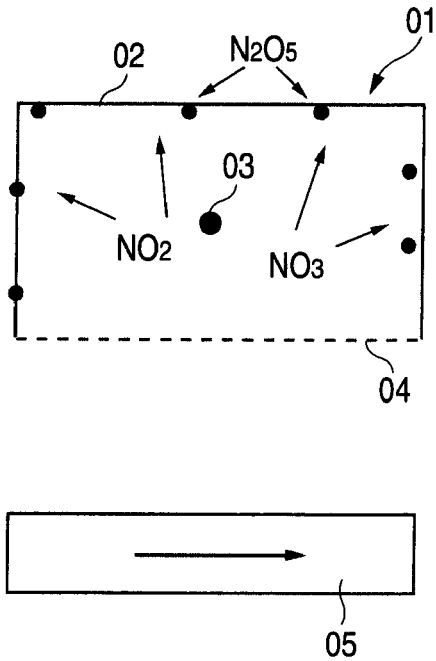
Figure 9C:
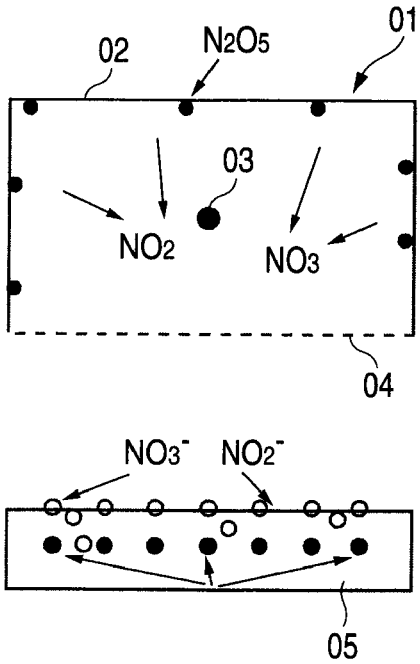
Figure 9D:
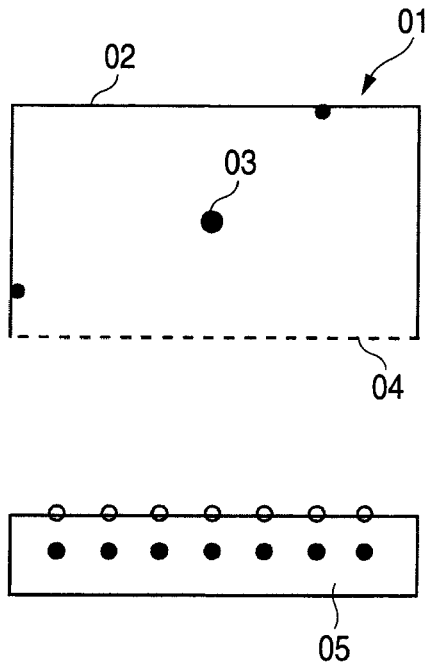

FIG. 9 is a diagram illustrating the principle that the resistance of the photosensitive member is lowered, and in which FIG. 9A is a diagram of a state at the start of a discharge, FIG. 9B is a diagram of a state where the discharge is continued, FIG. 9C is a diagram of a state where nitrogen oxides are emitted after an end of the discharge, and FIG. 9D is a diagram of a state where the resistance of the photosensitive member is lowered.

Referring to FIG. 9, in a shield electrode 02 of a conventional charging device 01 in which a surface layer of ta-C is not formed, ozone $O_3$ and a nitrogen oxide such as NO, $NO_2$, and $NO_3$ are produced by a discharge of a discharge electrode 03 as shown in FIG. 9A. Among the gases, $O_3$ and NO easily react with each other to become $NO_2$ or $NO_3$, and hence are hardly detected. Referring to FIG. 9B, NO, $NO_2$, and $NO_3$ which are produced during a discharge, i.e., during an image forming operation adhere to the shield electrode 02 and a net-like electrode member 04, and, when the concentration is increased, changed to $N_2O_5$ which is a solid to adhere. When changed to $N_2O_5$, it is hardly returned to $NO_2$ or $NO_3$ because the concentrations of $NO_2$ and $NO_3$ are high during the image forming operation.

Referring to FIG. 9C, when the image forming operation is ended, the concentrations of $NO_2$ and $NO_3$ are lowered in accordance with diffusion of the gasses. When the concentrations of $NO_2$ and $NO_3$ are lowered, $N_2O_5$ is returned to $NO_2$ or $NO_3$, and re-emitted into the charging device 01. The emitted gas has a high oxidizing property, and reacts with the opposed surface of a photosensitive drum 05, so that the resistance of the face opposed to the charging device 01 is lowered or deteriorated axially, i.e., in a strip-like manner along the main scanning direction. When the resistance of the photosensitive drum 05 is lowered in a strip-like manner along the main scanning direction as shown in FIG. 9D, an image flow, or so-called deletion occurs, and an image defect is produced.

By contrast, in the image forming apparatus U of Example 2 having the above-described configuration, attached or adsorbed discharge products are caused by ta-C to be easily separated, and hence most discharge products are emitted and evacuated in accordance with the air flow. Even when discharge products adhere to the ta-C surface layer formed on the inner face the shield electrode 1, formation of rust is reduced. The apparatus exerts the same effects as those of Example 1.

(Experiment 4)

In Experiment 4, a change of the emitted gas between the case where the surface layer of ta-C is formed, and that where the surface layer is not formed is measured.

In the experiment, discharge products are first accumulated on the charging device, then the charging device is mounted in an actual apparatus, and the concentrations of nitrogen oxides are measured. The conditions for accumulating discharge products on the charging device are set as follows. The charging device is placed in a cylindrical glass tube in which both ends are opened. From one end of the glass tube, dry air is introduced at a rate of 1 liter/min., and discharged from the other end. Under the temperature and humidity conditions of 24° C. and 3% RH, and the discharge conditions of −400 μA, a discharge is continuously performed for 20 hours. After discharge products are accumulated on the charging device under the conditions for accumulating discharge products, the charging device in a usual placement state is mounted in an actual apparatus placed in the environment of J Zone. A pipe for measuring nitrogen oxides is attached to the charging device, the air is sucked at a rate of 150 milliliters, and nitrogen oxides emitted from the charging device are measured by CLAD-1000 manufactured by SHIMADZU CORPORATION. FIG. 10 shows results of the measurements.

Figure 10A:
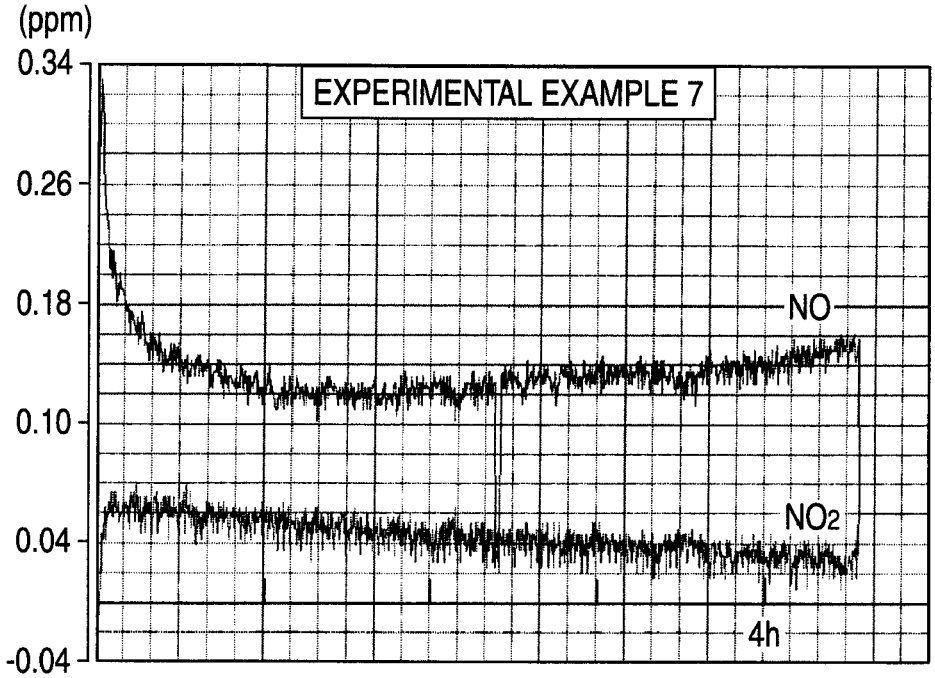
Figure 10B:
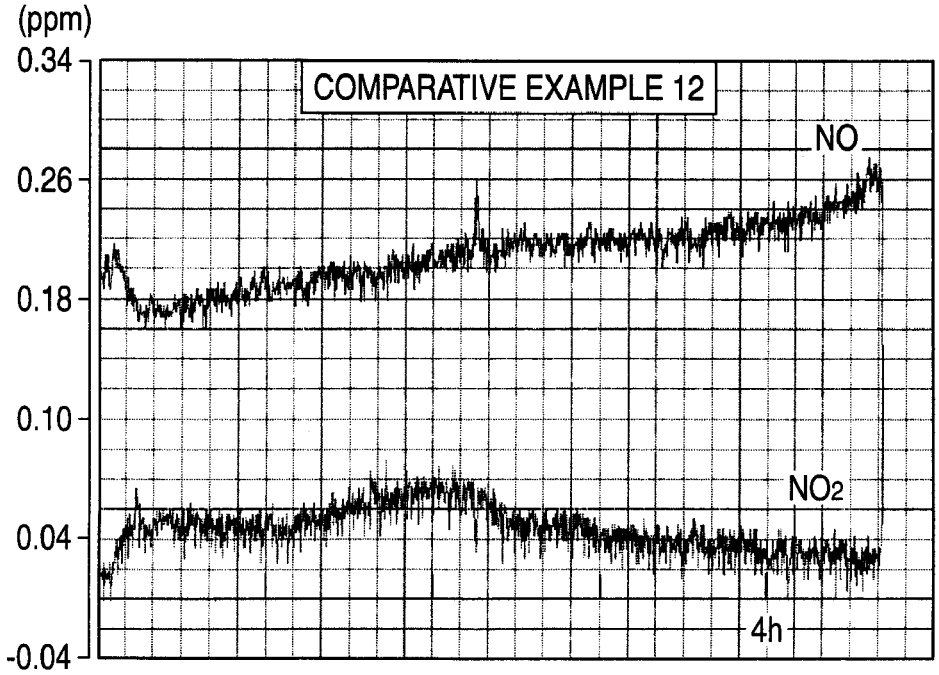

FIG. 10 is a view showing experimental results of Experiment 4 in Example 2. FIG. 10A is a graph of experimental results of Experimental example 7 in which the abscissa indicates the time and the ordinate indicates the concentration, and FIG. 10B is a graph of experimental results of Comparative example 12 in which the abscissa indicates the time and the ordinate indicates the concentration.

As shown in FIG. 10A, in Experimental example 7, the concentrations of NO and $NO_2$ are increased during a discharge. Because the air is rapidly discharged, however, the concentrations are not increased even when a time has elapsed after the discharge is ended. As a result, nitrogen oxides which are re-emitted from the shield electrode 1 are reduced, and lowering of the resistance of the photosensitive drum Py to Pk can be reduced. By contrast, as shown in FIG. 10B, in Comparative example 12, it is confirmed that, as time progresses, nitrogen oxides are emitted from the shield electrode 1 to raise the concentration of NO, and the resistance of the photosensitive drum Py to Pk is easily lowered.

(Modifications)

Although, in the above, the examples of the invention have been described in detail, the invention is not restricted to the examples. Various modifications are enabled within the scope of the spirit of the invention set forth in the claims. Modifications (H01) to (H09) of the invention will be exemplified.

(H01) In the examples, the invention is not restricted to a copier which is an example of an image forming apparatus, and can be applied also to an image forming apparatus such as a printer or a facsimile apparatus. The invention is not restricted to a color image forming apparatus, and can be applied also to a monochrome image forming apparatus. The invention is not restricted to a tandem image forming apparatus, and can be applied also to a rotary image forming apparatus.

(H02) In the examples, the case where the discharge electrode member 11 is a single thread-like member is exemplified. The invention is not restricted to this. A configuration which has two thread-like discharge electrode members, or the like can be employed.

(H03) In Example 2, the net-like electrode member 12 may be omitted.

(H04) In the examples, in the case where the surfaces of the photosensitive drums Py to Pk serving as an image carrier are configured by a material which has a high resistance to the resistance reduction due to a nitrogen oxide, it is preferable to employ the configuration of Example 1, and, in the case where the surfaces are configured by a material which has a low resistance to the reduction, it is preferable to employ the configuration of Example 2. Alternatively, in the case where the surfaces are configured by a material which has a high resistance, the configuration of Example 2 may be employed.

(H05) In the examples, a charging device which is an example of a discharger is exemplified. The invention is not restricted to this. The invention can be used also as a destaticizer, an auxiliary charging device, or the like which is an example of a discharger.

(H06) In the examples, the configurations of the air flow paths are not restricted to the above-described configurations of the examples, and may have arbitrary flow path configuration. In this case, the position of the air supply port 2*a* can be changed in accordance with the flow paths. During the waiting state, flow amounts of air supply and air discharge can be increased.

(H07) In the examples, the charging devices CCy to CCk are configured so as to be attachable to and detachable from the image forming apparatus U functioning as an image carrier unit. The invention is not restricted to this. The charging devices may be fixedly supported on the image forming apparatus U.

(H08) In the examples, the configuration of the electrode cleaning member 17 is not restricted to that exemplified in the examples, and may have any configuration in accordance with the design or the like. In place of the configuration in which the cleaning operation is automatically performed, for example, a configuration in which the user opens the interior and manually operates an operating portion to clean the electrode members 1, 11, 12 may be employed. The configuration of the brush or the cloth may be changed to any configuration which can perform a cleaning operation, such as a sponge. A cleaning portion which is in contact with the inner peripheral face of the shield electrode 1 may be disposed so that also the shield electrode 1 can be cleaned, or a cleaning portion may be disposed between the frame clamping portions 19*a* so as to form a configuration in which the both faces of the net-like electrode member 12 can be cleaned.

(H09) In the examples, the surface layer configured only by ta-C is exemplified. The configuration of the surface layer may be adequately changed in accordance with the use conditions and the purpose. Because of the configuration of the charging device, for example, the energized portion may be used also as the electrode, an energized portion to which the voltage is applied in a manner similar to the opposed-electrode terminal 3*a* may be disposed in the net-like electrode member, or the device may be so small that the resistance of the opposed electrode exerts an influence. In such a case, in order to lower the resistance, although the oxidation resistance is somewhat impaired, the rate of SP3 is lowered, the conductivity and the oxidation resistance are adjusted by doping (adding) $N_2$, Cr, Ti, or the like, so that a ta-C film in which an SP3 structure by a carbon atom is used as the main structure is formed, or a film is formed by DLC (Diamond-Like Carbon). Also the rate of the SP3 structure, the thickness of the thin film, and the configuration where the film is formed on one or both of the surface and the rear face can be adequately changed in accordance with the design or the like.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A discharger comprising:

a discharge electrode member that is placed opposedly to a member to be charged;

an opposed electrode member that is placed opposedly to the discharge electrode member; and a power source circuit that applies a discharge voltage for generating a discharge between the discharge electrode member and the opposed electrode member, and the opposed electrode member having first and second surfaces on which a covered layer having a covering material is formed, and the covering material containing a carbon atom, or a carbon atom and another atom or other plural atoms as a main component, and having an SP3 structure by a carbon atom, wherein the first surface is opposed to the discharge electrode member, the second surface is opposed to the member to be charged, and a thickness of the covering material formed on the first surface is substantially larger than a thickness of the covering material formed on the second surface.

2. The discharger as claimed in claim 1, wherein the opposed electrode member comprises:

a surrounding electrode member that is opened on a side of the member to be charged, and that surrounds a periphery of the discharge electrode member; and a net-like electrode member that is placed correspondingly with an opened portion of the surrounding electrode on the side of the member to be charged.

3. The discharger as claimed in claim 1, wherein the discharger comprises a gas transfer device that transfers a gas along a gas flow path passing through an interior of the opposed electrode member.

4. The discharger as claimed in claim 1, wherein the discharger comprises an electrode cleaning member that cleans the surface of the opposed electrode member.

5. The discharger as claimed in claim 1, wherein the opposed electrode member comprises an energized portion to which a voltage is applied, and the covering material further comprises at least one of nitrogen atom, chromium atom, titanium atom.

6. An image carrier unit comprising:

an image carrier that is rotated while carrying an image on a surface thereof, and that functions as a member to be charged; and a charging device that includes a discharger according to claim 1.

7. An image forming apparatus comprising:

an image carrier that is rotated while carrying an image on a surface thereof, and that functions as a member to be charged;

a charging device that includes a discharger according to claim 1;

a latent-image forming device that forms a latent image on a surface of the image carrier charged by the charging device;

a developing device that develops the latent image formed on the surface of the image carrier, as a visible image; and a transferring device that transfers the visible image on the surface of the image carrier, to a medium.

8. A discharger comprising:

a discharge electrode member that is placed opposedly to a member to be charged;

an opposed electrode member that is placed opposedly to the discharge electrode member;

a power source circuit that applies a discharge voltage for generating a discharge between the discharge electrode member and the opposed electrode member; and an energized portion that is energized by the discharge voltage applied by the power source circuit, the opposed electrode member having first and second surfaces on which a covered layer having a covering material is formed, the covering material containing a carbon atom, or a carbon atom and another atom or other plural atoms as a main component, and having an SP3 structure by a carbon atom, and the energized portion being not covered by the covering material wherein:

the first surface is opposed to the discharge electrode member, the second surface is opposed to the member to be charged, and a thickness of the covering material formed on the first surface is substantially larger than a thickness of the covering material formed on the second surface.

* * * * *